US009956471B2

(12) United States Patent
Nylund

(10) Patent No.: US 9,956,471 B2
(45) Date of Patent: May 1, 2018

(54) PROTECTIVE STRUCTURE FOR SPORTING EQUIPMENT

(71) Applicant: LICENSING CORPORATION OF FINLAND OY, Savitaipale (FI)

(72) Inventor: Mauri Nylund, Savitaipale (FI)

(73) Assignee: LICENSING CORPORATION OF FINLAND OY, Savitaipale (FI)

( * ) Notice: Subject to any disclaimer, the term of this patent is extended or adjusted under 35 U.S.C. 154(b) by 0 days. days.

(21) Appl. No.: 14/653,130

(22) PCT Filed: Dec. 16, 2013

(86) PCT No.: PCT/FI2013/051168
§ 371 (c)(1),
(2) Date: Jun. 17, 2015

(87) PCT Pub. No.: WO2014/102451
PCT Pub. Date: Jul. 3, 2014

(65) Prior Publication Data

US 2015/0328527 A1 Nov. 19, 2015

(30) Foreign Application Priority Data

Dec. 27, 2012 (FI) ..... 20126377

(51) Int. Cl.
*B32B 3/12* (2006.01)
*B32B 3/30* (2006.01)
(Continued)

(52) U.S. Cl.
CPC ..... *A63B 71/12* (2013.01); *A41D 13/015* (2013.01); *A41D 13/05* (2013.01);
(Continued)

(58) Field of Classification Search
CPC . A63B 71/12; A63B 71/1225; A63B 2102/24; A63B 2071/1233;
(Continued)

(56) References Cited

U.S. PATENT DOCUMENTS 4,566,458 A 1/1986 Weinberg
5,090,053 A 2/1992 Hayes
(Continued)

FOREIGN PATENT DOCUMENTS

FI 103862 B 4/1995
FR 442641 A 9/1912
(Continued)

OTHER PUBLICATIONS

Office Action dated Mar. 24, 2016 for Canadian Application No. 2,896,423.
English_Abstract_of_FI103862B.

*Primary Examiner* — Joanna Pleszczynska
(74) *Attorney, Agent, or Firm* — Ladas & Parry LLP

(57) ABSTRACT

The protective structure comprises a at least in one direction curved support rib structure of a material or a material composition that is suited for injection molding, which support rib structure is formed of an outer frame and of inner frames fitted into the interior space of the outer frame and being fixed to each other and/or to the outer frame. The material thickness of the support rib structure varies in a direction perpendicular to a surface formed by the support rib structure so that the material thickness is greater at the middle of the support rib structure compared to the material thickness at the edges of the support rib structure.

19 Claims, 4 Drawing Sheets

(51) Int. Cl.

| | |
|---|---|
| ***A63B 71/12*** | (2006.01) |
| ***A41D 13/05*** | (2006.01) |
| ***A41D 13/015*** | (2006.01) |
| *A63B 102/24* | (2015.01) |

(52) U.S. Cl.
CPC ..... *A63B 71/1225* (2013.01); *A41D 13/0506* (2013.01); *A41D 13/0543* (2013.01); *A63B 2071/1233* (2013.01); *A63B 2071/1241* (2013.01); *A63B 2071/1258* (2013.01); *A63B 2102/24* (2015.10); *A63B 2209/02* (2013.01); *A63B 2243/0025* (2013.01)

(58) Field of Classification Search
CPC .... A63B 2071/1241; A63B 2071/1258; A63B 2071/1244; A63B 2071/208; A41D 13/015; A41D 13/05; A41D 13/0506; A41D 13/0518; A41D 13/065; A41D 13/0543; Y10T 428/24149; Y10T 428/24537; Y10T 428/2457; Y10T 428/24612; Y10T 428/24165; B32B 3/12
USPC ..... 428/156; 2/22, 24, 455, 461, 463
See application file for complete search history.

(56) References Cited

U.S. PATENT DOCUMENTS

| | | | | |
|---|---|---|---|---|
| 5,245,706 | A * | 9/1993 | Moschetti | A63B 71/12 2/2.5 |
| 5,557,804 | A | 9/1996 | Ovortrup et al. | |
| 5,737,770 | A | 4/1998 | Chen | |
| 6,336,220 | B1 * | 1/2002 | Sacks | A41D 31/005 116/203 |
| 6,389,603 | B1 | 5/2002 | Dorantes Perez | |
| 2003/0088900 | A1 | 5/2003 | Cho | |
| 2011/0277226 | A1 | 11/2011 | Turner | |

FOREIGN PATENT DOCUMENTS

| | | | |
|---|---|---|---|
| GB | 2460019 | A | 11/2009 |
| WO | 2010/104868 | A2 | 9/2010 |

* cited by examiner

PROTECTIVE STRUCTURE FOR SPORTING EQUIPMENT

RELATED APPLICATION INFORMATION

This application is a 371 of International Application PCT/FI2013/051168 filed 16 Dec. 2013, which claims priority from Finnish Application No.: 20126377 filed 27 Dec. 2012, the content of which is incorporated herein by reference.

TECHNICAL FIELD

The invention is directed to a protective structure for sporting equipment according to the preamble of claim 1.

The invention is also directed to a method for producing a protective structure for sporting equipment according to the preamble of claim 11.

Sporting equipment such as protective equipment for ice hockey, football etc. comprises protective structures. Protective structures are present e.g. in ice hockey leg shields, breast and shoulder shields and in pants. The protective structures are fairly stiff structures usually made of plastic material, the purpose of the protective structures being to receive shocks and to distribute the energy of the shock to a wider area.

BACKGROUND ART

Protective structures for sporting equipment have traditionally been made from sheet like material by die-cutting and by shaping the die-cut piece as it is subjected to heat to a desired shape. Also bends have been done to the sheet like material during die-cutting in order to achieve stiffness to the piece. Also openings could have been done to the piece during die-cutting in order to make the piece lighter. Plastic has normally been used as the material. Such protective structures have been used in the outer surface of sporting equipment e.g. ice hockey leg shields or within the sporting equipment between softer protective structures e.g. between foamed plastics. The purpose of the protective structure is to receive shocks from the outside and to distribute the energy of the shock to a wider area.

A protective structure made of sheet like material by die-cutting becomes fairly heavy. The thickness of the material is the same throughout the whole piece and the ability of the piece to distribute shocks effectively to a wider area remains rather limited.

FI-patent 103862 shows a protective pad for an outfit equipped with separate protective pads that are inserted into pockets. The protective pad is composed of a flexible cellular protective pad material which retains its shape and comprises interconnected walls which extend from an outer surface to an inner surface of the protective pad, said walls having a width in the direction of the surface of the pad which is smaller than the height of the wall in the thickness direction of the protective pad. The walls form cells with a closed periphery such that between the walls of the cells there remain holes extending through the pad. The pad is advantageously made from a sheet like cellular material by cutting the material into a shape having the appropriate contour. The width of the walls increases advantageously from the outer surface towards the inner surface of the pad. The pad can be manufactured e.g. by injection molding or by producing a cellular sheet, where cells needed for the pad are on a big sheet. The height of the walls i.e. the thickness of the pad is the same on the whole area of the pad.

DISCLOSURE OF INVENTION

The goal of the invention is to present an improvement to prior art protective structures.

The characterizing features of the protective structure according to the invention are presented in the characterizing portion of claim 1.

The characterizing features of the method according to the invention are presented in the characterizing portion of claim 11.

The protective structure of a sporting equipment comprises a at least in one direction curve support rib structure of a material or material composition that is suited for injection molding, which support rib structure is formed of an outer frame and of inner frames fitted into the interior space of the outer frame and being fixed to each other and/or to the outer frame. The protective structure is characterized in that the material thickness of the support rib structure varies in a direction perpendicular to a surface formed by the support rib structure so that the material thickness is greater at the middle of the support rib structure compared to the material thickness at the edges of the support rib structure.

The support rib structure forms a cell like structure having a large open surface. The large open surface contributes in making the protective structure light. The support ribs can be dimensioned so that the width of the support ribs in the direction of the surface of the support structure is smaller than the height of the support ribs in the direction perpendicular to the surface of the support structure. With the height of the support ribs it is possible to regulate the stiffness of the protective structure in the direction perpendicular to the surface of the protective structure. The support ribs can on the other hand be kept narrow in the direction of the surface of the protective structure in order to achieve a large open area. A large open area makes the air permeability of the protective structure also especially high.

The protective structure can thus on the other hand be made light, but on the other hand stiff enough. The stiffness of the protective structure can be regulated also by changing the size of the inner frame. By using small inner frames a more stiff structure is achieved and by expanding the inner frames a more loose structure is achieved when the material thicknesses of the support ribs are kept the same.

The amount of material used in the support rib structure can be optimized in relation to the stiffness by varying the thickness of the support rib structure in a direction perpendicular to the surface formed by the support rib structure so that the material thickness is greater at the middle of the support rib structure compared to the thickness at the edges of the support rib structure. The material can be concentrated on those portions of the support rib structure where the benefit in relation to the stiffness is the greatest. By concentrating material more to the middle of the support structure the middle part of the support structure will become more stiff and the edges more loose. The middle part of the support structure does in this way receive effectively chocks and transfers chock energy to the edges of the support structure. The more loose edge parts of the support structure also contribute to the fitness of the support structure in sporting equipment, which improves the user comfort of the support structure.

The support structure transfers effectively the energy of a chock hitting the support structure from the firm crossing points of the support ribs in every direction of the support structure. The support rib structure can also be designed so that a chock hitting the support structure transfers through the support structure into a plastic foam structure under the support structure. The support structure will thus penetrate a certain distance into the plastic foam structure whereas the energy of the chock is absorbed into the plastic foam structure.

The support structure for sporting equipment according to the invention is suited for use in all such sporting equipment where the aim is to protect the user from exterior chocks. Sporting equipment comprising such protective structures are used in e.g. ice hockey and football. The protective structure is suitable for objects where some resilience in addition to stiffness is needed. The protective structure receives the chock, is resilient in an appropriate manner and transfers the energy of the chock into a larger area. The protective structure can be at the surface of the sporting equipment such as in the outer surface of a leg shield used in ice hockey or in the outer surface of an ice hockey helmet or within the sporting equipment between other layers such as within pants used in ice hockey in order to protect the area of the waist or the thighs. Pieces of protective structures of different shapes, different sizes, having different curvatures, having curvatures in many directions etc. can be used in different positions in sporting equipment.

When the protective structure is manufactured by injection molding the waist of raw material can be minimized compared to a protective structure manufactured by cutdying. There is always a rather big waist when pieces of a desired size and form are die-cut from a uniform sheet with die-cut technique. Injection molding makes it is also possible to optimize the thickness of the support ribs so that a sufficient stiffness/strength is achieved with a minimum of material. Injection molding makes it possible to design the form of the support ribs and thus also the form of the whole protective structure in a desired way. The support rib structure can thus be designed esthetically in a desired way. Suitable materials for injection molding are all plastic materials as well as plastic materials into which other reinforcement materials such as e.g. carbon fiber have been mixed. The material must naturally be such that the material becomes hard enough after hardening. The protective structure can be manufactured from such a plastic grade or such a mixture of a plastic and a reinforcement material that are best suitable for each use.

BRIEF DESCRIPTION OF DRAWINGS

The invention will in the following be explained more in detail be reference to the attached figures in which.

DETAILED DESCRIPTION OF SOME EMBODIMENTS OF THE INVENTION

Figure 1:
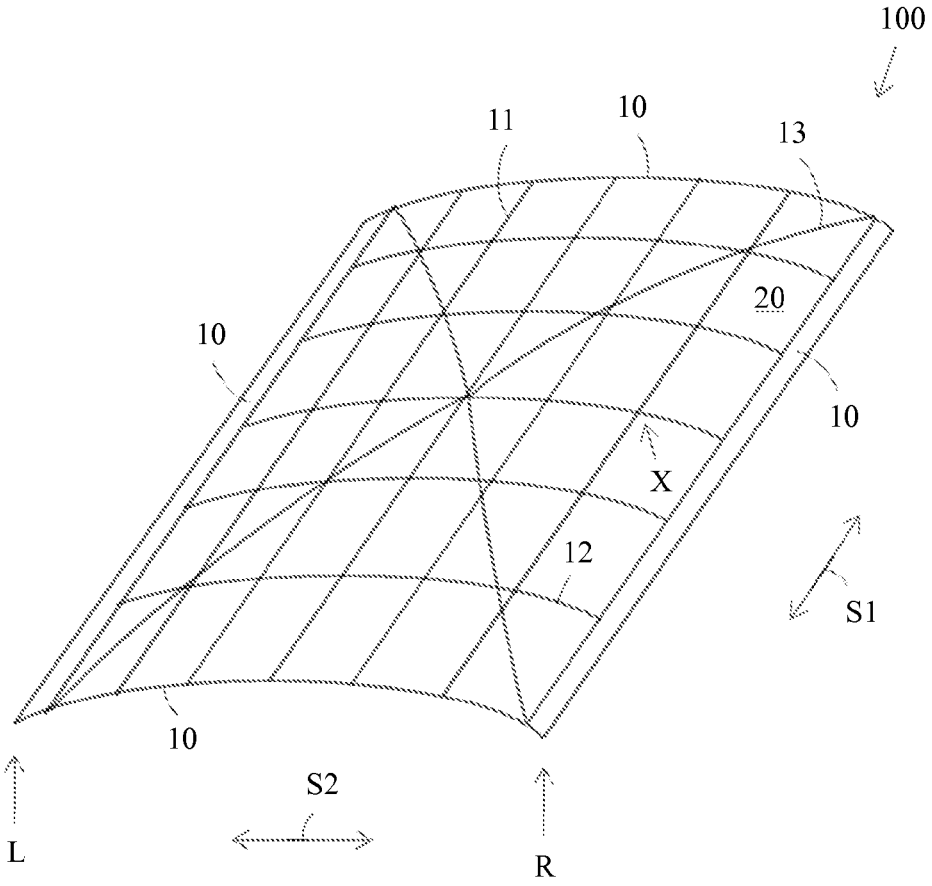
FIG. 1 presents an axonometric figure of a protective structure according to the invention.

FIG. 1 presents an axonometric figure of a protective structure according to the invention. The protective structure comprises a curved, mesh like or cell like support rib structure 100. The support rib structure 100 is formed of support ribs 11 extending in a first direction S1 i.e. in a length direction and of crossing support ribs 12 extending in a second direction i.e. in a traverse direction. The outermost support ribs 11, 12 in each direction S1, S2 form an outer frame 10 of the support rib structure 100. Inner frames 20 are formed between the crossing points X of the support ribs 11, 12. The support rib structure 100 comprises further crossing support ribs 13 extending in a third direction S3 and in a fourth direction S4. The support ribs 11 extending in the longitudinal direction S1 are straight. The support ribs 12 extending in the traverse direction S2 and the crossing support ribs 13 are curved. The longitudinal S1 support ribs 11 at each outer edge L, R of the support rib structure 100 are a little bit wider compared to the other longitudinal S1 support ribs 11. These a little bit wider support ribs 11 form a uniform end support surface for the support ribs 12 in the traverse direction S2. The wider support ribs 11 are situated at the outer edges L, R of the support rib structure 100 in which case a force directed to the support rib structure 100 is transferred via these further to a structure inside to support rib structure 100. The support rib structure 100 can also be fastened to the sporting equipment from these wider support ribs 11 by sewing. The form of the traverse S1 support ribs 12 is advantageously such that they comprise a wider section at the point where they join the wider longitudinal S1 support ribs 11. The support ribs 11, 12, 13 are in each crossing point X firmly attached to each other. The thickness of the support ribs 11, 12, 13 is in each crossing point X essentially the same. There are seven longitudinal S1 support ribs 11 of which two are a little bit wider compared to the other, seven traverse S2 support ribs 12 and two crossing support ribs 13. The crossing support ribs 13 extend between opposite corners of the protective structure 100.

The protective structure is manufactured by injection molding from a material or material combination suitable for injection molding. All plastic materials and plastic materials into which reinforcement material such as carbon fiber has been mixed are usually suitable raw material in an injection molding process. In an injection molding process it is possible to manufacture automatically with machines and auxiliary equipment pieces of different shape. In an injection molding process the raw material granulates are plasticized into a mass in a melting cylinder by means of heat e.g. heat produced by electric resistances as well as by means of the friction caused by the rotation of the worm screw. The melted material is injected with a great pressure into a cooled mold. In the mold, which is usually made of steel, the mass solidifies into the desired form. After a certain cooling period the mold is opened and the piece is pushed out from the mold.

Figure 2:
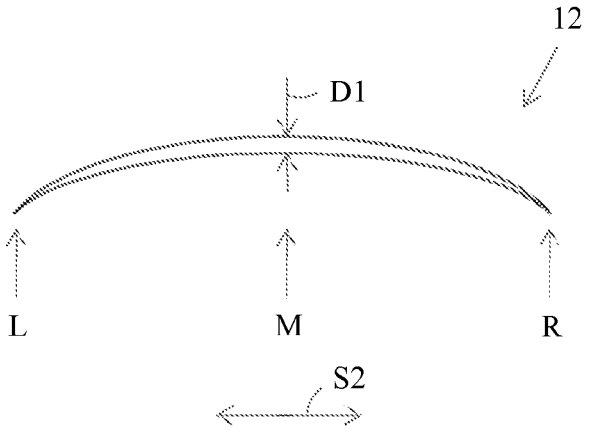
FIG. 2 presents a cross-section of one support rib of the protective structure shown in FIG. 1.

FIG. 2 presents a cross-section of one support rib of the protective structure shown in FIG. 1. The figure shows one curved support rib 12 extending in the traverse direction S2. The thickness D1 of the curved support rib 12 in a direction perpendicular to the surface formed by the support rib structure 100 is greatest at the middle M of the support rib structure 100 and decreases uniformly towards each edge L, R of the support rib structure 100. The stiffness of the support rib 12 extending in the traverse direction S2 is thus greater at the middle M of the support rib structure 100 compared to the stiffness at the edges L, R of the support rib structure 100. The thickness of the longitudinal S1 support ribs 11 can be adapted according to the respective thickness of the traverse S2 support ribs 12. The longitudinal S1 support ribs 11 at the middle M of the support structure 100 may thus be thicker than the longitudinal S1 support ribs 11 on the edges L, R of the support structure 100. The thickness of the support ribs 11, 12, 13 is essentially the same in each crossing point X. It is advantageous from a manufacturing point of view to manufacture a mold where the thickness D1 of the curved support rib 12 decreases uniformly, but it could also decrease in steps.

Figure 3:
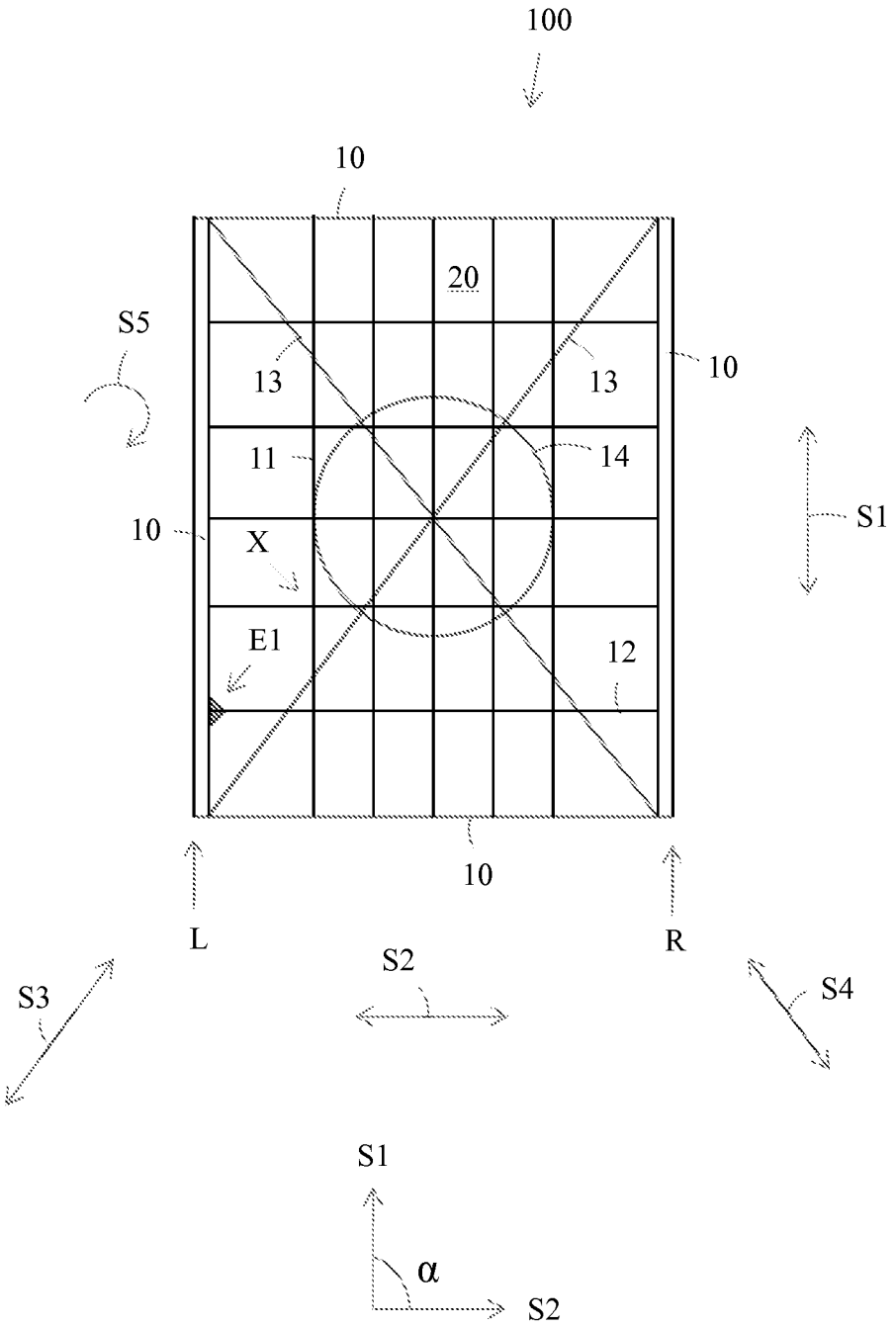
FIG. 3 presents a plane view of a protective structure according to the invention.

FIG. 3 presents a plane view of a protective structure according to the invention. The support rib structure 100 comprises support ribs 11 extending in a first direction S1 i.e. in a longitudinal direction, support ribs 12 extending in a second direction S2 i.e. a traverse direction, crossing ribs 13 extending in a third direction S3 and in a fourth direction S4 as well as a circular support rib 14 extending in a fifth direction S5. The outermost support ribs 11, 12 in the support rib structure 100, form the outer frame 10 of the support rib structure 100. The crossing points X of the support ribs 11 extending in the longitudinal direction S1 and the support ribs 12 extending in the traverse direction S2 limit within them inner frames 20. These inner frames 20 are essentially rectangular and adjoining inner frames have a common support rib. The circular support rib 14 gives further stiffness to the support rib structure 100. The support ribs 11, 12, 13, 14 are in each crossing point X firmly attached to each other.

The longitudinal S1 support ribs 11 in each outer edge L, R are a little bit wider compared to the other longitudinal S1 support ribs 11. These a little bit wider support ribs 11 form a uniform end support surface for the support ribs 12 in the traverse direction S2. It is not necessary to have wider support ribs in the outer edges L, R of the support rib structure 100, but all support ribs 11 can be of the same width.

The width of the support ribs 11, 12, 13, 14 in the direction of the surface of the support rib structure 100 can be kept fairly small. The open surface area of the protective structure is thus at least 50%, advantageously at least 60% and most advantageously at least 70% of the total area of the protective structure. The protective structure becomes thus very light due to the large open surface are. The thickness of the support ribs 11, 12, 13, 14 in a direction perpendicular to the surface of the protective structure is advantageously the same in each cross point X. The plane angle $\alpha$ between the longitudinal direction S1 and the traverse direction S2 is in this embodiment 90 degrees. The figure also shows a widening E1 of one traverse S2 support rib 12 at the point where it becomes united with the longitudinal S1 support rib 11 in the outer edge L. Such a widening E1 can be present in each juncture between a traverse S2 support rib 12 and the longitudinal S1 support ribs 11 in the outer edges L, R. Such widenings can also when needed be used in the other junctions between the support ribs 11, 12, 13, 14.

Figure 4:
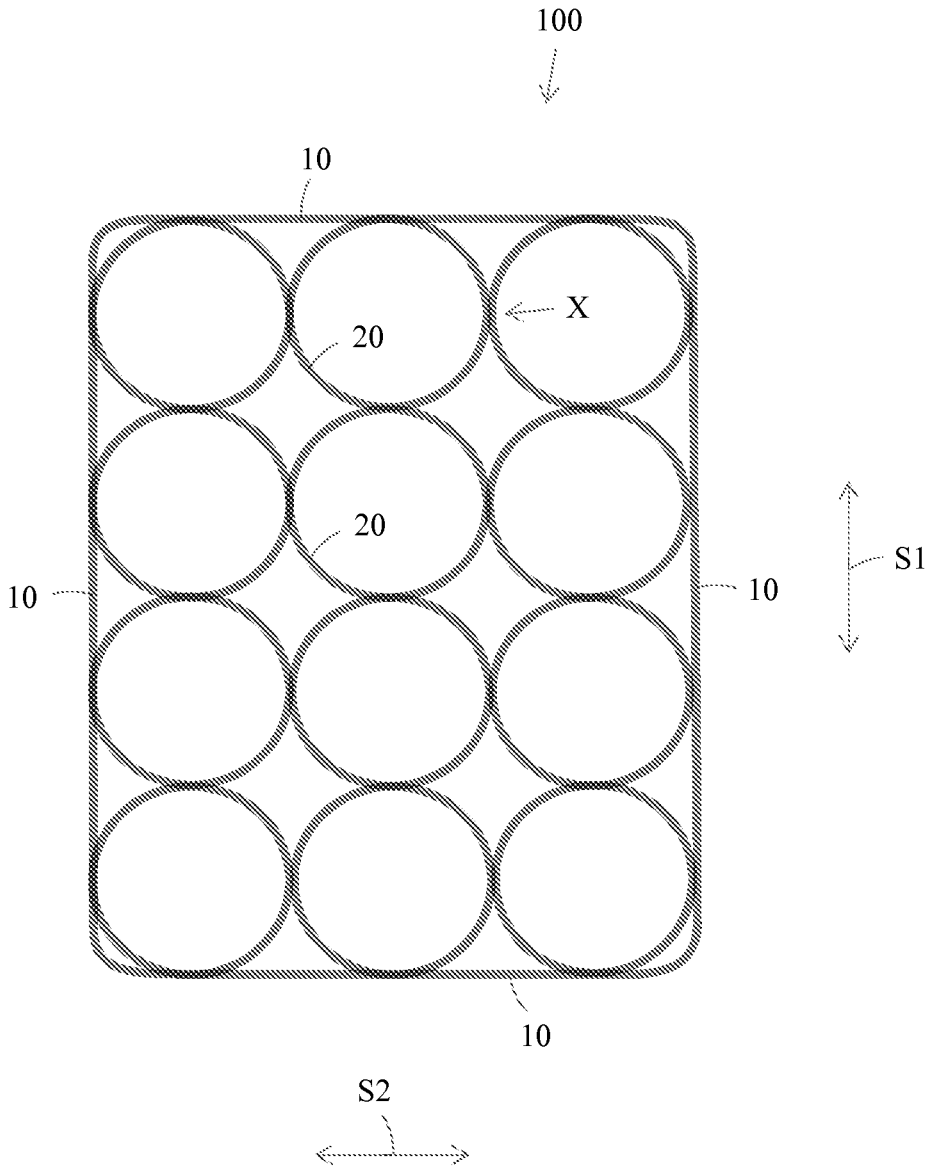
FIG. 4 presents a plane view of a second protective structure according to the invention.

FIG. 4 presents a plane view of a second protective structure according to the invention. The protective structure is in this embodiment formed of an outer frame 10 and of inner frames 20 adapted inside it. The outer frame 10 is formed of longitudinal S1 and traverse S2 support ribs as in the embodiments shown in the previous figures. The inner frames 20 are formed of circle circumferences. Each inner frame 20 is fixedly attached through four support points i.e. crossing points X to the outer frame 10 and/or to each adjacent inner frame 20. The stiffness of this protective structure can be changed by changing the size of the inner frames 20 i.e. the radius of the circles. With larger inner frames 20 a looser structure is achieved and with smaller inner frames 20 a stiffer structure is achieved. Also different sized inner frames 20 i.e. circumferences of circles can also be used in different positions in the protective structure. Naturally also the thickness of the circle circumferences in a direction perpendicular to the surface of the protective structure, affect the stiffness of the circle circumferences. The wideness of the outer frame and the inner frame in the direction of the surface of the protective structure can also in this embodiment be kept small whereas the open surface of the protective structure becomes large.

Figure 5:
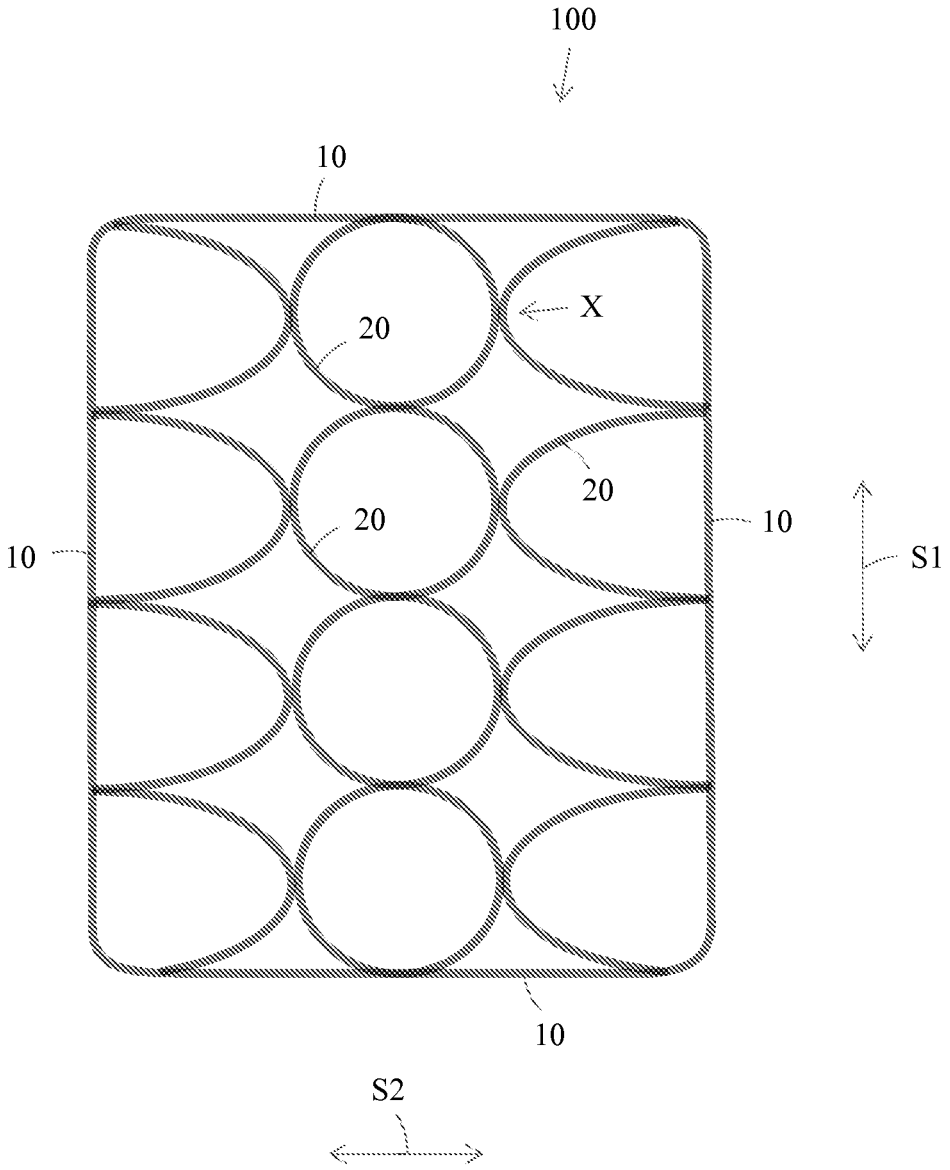
FIG. 5 presents a plane view of a third protective structure according to the invention.

FIG. 5 presents a plane view of a third protective structure according to the invention. The protective structure is in this embodiment formed of an outer frame 10 and of inner frames 20 adapted inside it. A part of the inner frames 20 are formed of circle circumferences and a part of the inner frames are formed of half ellipse circumferences. Each inner frame 20 is fixedly attached through four support points i.e. crossing points X to the outer frame 10 and/or to each adjacent inner frame 20. Each inner frame 20 having the form of a half ellipse circumference is fixedly attached through three support points i.e. crossing points X to the outer frame 10 and/or to each adjacent inner frame 20. The wideness of the outer frame and the inner frame in the direction of the surface of the protective structure can also in this embodiment be kept small whereas the open surface of the protective structure becomes large.

In the embodiments shown in FIGS. 1 to 3, the outer frame 10 of the support rib structure 100 is essentially rectangular, whereas the support rib structure has a clear longitudinal direction S1 and a traverse direction S2. The outer frame 10 of the support rib structure 100 can naturally be of any form, e.g. a circle, an ellipse, a trapeze, a polygon, a rectangle or a combination of these etc. A clear longitudinal and traverse direction cannot thus be identified, but the support ribs 11, 12, 13, 14 run also in such cases at least in two directions forming a grid structure. It is also not necessary to have wider support ribs 11 in the outer frame 10, but the support ribs can be of equal width.

The inner frames 20 of the support rib structure 100 are in the embodiments in FIGS. 1 to 3 rectangular. The rectangular form is achieved when the angle $\alpha$ between the first direction S1 and the second direction S2 is 90 degrees. In a situation where the angle $\alpha$ between the first direction S1 and the second direction S2 deviates from 90 degrees, the inner frames 20 become oblique. The size of the inner frames 20 may vary within different parts of the support rib structure 100. The stiffness of the support rib structure 20 can be varied by changing the size of the inner frames 20.

The inner frames 20 have in the embodiments shown in FIGS. 4 to 5 the form of circle circumferences or half ellipse circumferences. The protective structure becomes usually rather stiff with these forms of inner frames.

The inner frames 20 could in principal be of any form such as rectangular, oblique, trapeze, circle circumference, part of circle circumference, ellipse circumference, part of ellipse circumference or any combination of these etc.

The curvature of the protective structure in the embodiments in the figures is only in one direction, but the curvature can be in many different directions. The protective structure could e.g. have the form of a hemisphere, a half rotation ellipse or any combination of these etc.

There could be any number of support ribs running in different directions. With the number of support ribs and thus the number of inner frames one can influence the stiffness of the protective structure.

The outer frame 10 and the inner frames 20 in the protective structure form in each embodiment one single uniform structure, which is formed in one single injection mold process.

The invention is not intended to be limited only to the embodiments presented here, but the details of the invention may vary within the scope of protection defined by the attached claims.

The invention claimed is:

1. A protective structure for sporting equipment comprises a curved support rib structure of a material or material composition that is suited for injection molding, which support rib structure comprises an outer frame formed of at least one outer support rib forming a closed outer perimeter of the protective structure and inner cells formed of support ribs, said inner cells being fitted into the interior space of the outer frame with a portion of the inner cells being connected to the outer frame and to other inner cells and a remainder of the inner cells being connected only to other inner cells in order to form a uniform curved mesh-like or cell-like support rib structure, wherein the material thickness of the support rib structure varies in a direction perpendicular to the curve of the support rib structure so that the material thickness is greater at the middle of the support rib structure compared to the material thickness at edges of the support rib structure, wherein the material thickness of the support rib structure decreases from the middle of the support rib structure to the edges with the decrease in thickness being continuous and uniform and with the material or material composition of the support rib structure being smooth, and wherein the outer frame and the inner cells comprise a uniform structure that is formable in one single injection mold process.

2. The protective structure according to claim 1, wherein the outer frame is of a rectangular form and the inner cells (10) are of a rectangular form.

3. The protective structure according to claim 1, wherein the support rib structure comprises a first set of support ribs running in a first direction and a second set of support ribs running in a second direction so that the first and second sets of support ribs cross at a plurality of crossing points, wherein at each crossing point the first and second sets of support ribs are firmly attached to each other, whereby the first and second sets of support ribs form the support rib structure with a grid-like structure wherein the outermost support ribs of the respective first and second sets of support ribs form the outer frame and wherein the crossing points of the first and second sets of support ribs form the boundaries of the inner cells.

4. The protective structure according to claim 1, wherein the outer frame of the support rib structure is rectangular and the inner cells have the form of a circle periphery.

5. The protective structure according to claim 1, wherein the outer frame of the support rib structure is rectangular and some of the inner cells have the form of a circle periphery and other of the inner cells have the form of a half-ellipse periphery.

6. The protective structure according to claim 1, wherein the protective structure has an open surface area that is at least 50% of the total area of the protective structure.

7. The protective structure according to claim 1, wherein the protective structure has an open surface area that is at least 60% of the total area of the protective structure.

8. The protective structure according to claim 1, wherein the protective structure has an open surface area that is at least 70% of the total area of the protective structure.

9. The protective structure according to claim 3, wherein each of the support ribs of the second set of support ribs has a thickness that is greater in the middle of the support rib structure than at the edges of the support rib structure.

10. The protective structure according to claim 1, wherein the outer frame defines the interior space of the support rib structure, and wherein the inner cells are present throughout the interior space of the support rib structure in the uniform mesh-like or cell-like form.

11. The protective structure according to claim 1, wherein a plurality of the inner cells are affixed to the outer frame.

12. A protective structure for sporting equipment comprising a curved support rib structure of a material or material composition that is suited for injection molding, which support rib structure comprises an outer frame formed of at least one outer support rib forming a closed outer perimeter of the protective structure and inner cells formed of support ribs, said inner cells being fitted into the interior space of the outer frame with a portion of the inner cells being connected to the outer frame and to other inner cells and a remainder of the inner cells being connected only to other inner cells in order to form a uniform curved mesh-like or cell-like support rib structure, wherein the material thickness of the support rib structure varies in a direction perpendicular to the curve of the support rib structure so that the material thickness is greater at the middle of the support rib structure compared to the material thickness at edges of the support rib structure, wherein the material thickness of the support rib structure decreases from the middle of the support rib structure to the edges with the decrease in thickness being continuous and uniform and with the material or material composition of the support rib structure being smooth, and wherein the outer frame comprises first and second elongate support ribs running in a first direction and second and third elongate support ribs running in a transverse direction.

13. The protective structure according to claim 1, wherein the protective structure is formed by (a) plasticizing material granulates into a mass in a melting cylinder by means of heat and by means of friction caused by rotation of a worm screw to form a melted material, and (b) injecting the melted material under pressure into a cooled mold in which the material solidifies into a solid piece that is then pushed out of the mold.

14. A protective structure for sporting equipment comprising a curved support rib structure of a material or material composition that is suited for injection molding, which support rib structure comprises an outer frame formed of an elongate support rib or a plurality of elongate outer support ribs forming a closed outer perimeter of the protective structure and inner cells formed of support ribs, said inner cells being fitted into the interior space of the outer frame with a portion of the inner cells being connected to the outer frame and to other inner cells and a remainder of the inner cells being connected only to other inner cells in order to form a uniform curved mesh-like or cell-like support rib structure, wherein the material thickness of the support rib structure varies in a direction perpendicular to the curve of the support rib structure so that the material thickness is greater at the middle of the support rib structure compared to the material thickness at edges of the support rib structure, wherein the material thickness of the support rib structure decreases from the middle of the support rib structure to the edges with the decrease in thickness being continuous and uniform and with the material or material composition of the support rib structure being smooth, and wherein the support ribs forming the inner cells intersect the outer frame at respective points that are spaced from each other.

15. The protective structure according to claim 14, wherein the plurality of elongate outer support ribs of the outer frame comprise first and second elongate support ribs running in a first direction and second and third elongate support ribs running in a transverse direction.

16. The protective structure according to claim 14, wherein each of the support ribs forming the inner cells is elongate.

17. The protective structure according to claim 16, wherein each of the elongate support ribs forming the inner cells has a first end and a second end and wherein each of the first end and second end is connected to the outer frame.

18. The protective structure according to claim 14, wherein the protective structure is formed by (a) plasticizing material granulates into a mass in a melting cylinder by means of heat and by means of friction caused by rotation of a worm screw to form a melted material, and (b) injecting the melted material under pressure into a cooled mold in which the material solidifies into a solid piece that is then pushed out of the mold.

19. The protective structure according to claim 1, wherein the protective structure is formed by (a) plasticizing material granulates into a mass in a melting cylinder by means of heat and by means of friction caused by rotation of a worm screw to form a melted material, and (b) injecting the melted material under pressure into a cooled mold in which the material solidifies into a solid piece that is then pushed out of the mold.

* * * * *